US005181549A

United States Patent [19]

Shapovalov

[11] Patent Number: 5,181,549

[45] Date of Patent: Jan. 26, 1993

[54] METHOD FOR MANUFACTURING POROUS ARTICLES

[75] Inventor: Vladimir I. Shapovalov, Dnepropetrovsk, U1. Chernyshevskogo, U.S.S.R.

[73] Assignee: Dmk Tek, Inc., Ann Arbor, Mich.

[21] Appl. No.: 693,920

[22] Filed: Apr. 29, 1991

[51] Int. Cl.[5] ..... B22D 27/13

[52] U.S. Cl. ..... 164/79; 164/66.1; 164/122.1

[58] Field of Search ..... 164/79, 80, 4.1, 458, 164/259, 120, 122, 122.1, 66.1; 264/42, 332

[56] References Cited

U.S. PATENT DOCUMENTS 3,554,717 1/1971 Shaffer et al. ..... 264/332
3,998,264 4/1982 Hocking ..... 164/80
4,707,312 11/1987 Bajaj ..... 264/42
4,973,358 11/1990 Jin et al. ..... 164/79

*Primary Examiner*—Richard K. Seidel
*Assistant Examiner*—Erik R. Puknys
*Attorney, Agent, or Firm*—Harness, Dickey & Pierce

[57] ABSTRACT

A process for forming porous articles. The method utilizes an enclosed vessel in which a base material is melted into a molten state. A gas, whose solubility in the base material decreases with decreasing temperature of the base material and increases with increasing pressure of the gas, is dissolved into the base material. Means are provided for cooling the base material while maintaining the gas at a predetermined pressure thereby causing the gas to precipitate during cooling forming pores in the solidified base material.

19 Claims, 4 Drawing Sheets

METHOD FOR MANUFACTURING POROUS ARTICLES

BACKGROUND AND SUMMARY OF THE INVENTION

The invention generally relates to method for manufacturing porous articles having a predetermined structure and properties. As such, the invention is well suited for producing metallic and nonmetallic materials having open or closed pore structures of predetermined sizes and shapes.

A number of techniques have been proposed for manufacturing porous articles. The most widely used techniques are those based on the sintering of powders, chips, fibers, nets, channeled plates and combinations thereof. Also known in the art are processes using a slurry which is foamed and subsequently baked and sintered. Other processes known in the art include slip forming or slurry casting techniques. In slip forming, porous cellular materials are produced by pouring slip into a porous mold whose contents are subsequently dried and baked to remove the slip fluid and leave behind a powder compact. Another method which is presently used is based on the depositing of a metal onto an organic substrate, such as polyurethane, which is then removed by thermal-decomposition.

The nature of the present invention includes features more closely related to processes used for casting metals, including melting a base metal or alloy and subsequently solidifying the melt to form the required composite.

In the field of metal casting, there are a number of considerably different techniques. Several methods of casting a cellular material are similar to investment casting. In one method, a foamed plastic, having interconnecting pores, is filled with a fluidized refractory material which is subsequently hardened. Upon heating and vaporizating the plastic, a spongy, skeletal mold is produced. A melt is then poured into the mold and, after solidification, a cellular structure is obtained. This method has particular application with metals having low melting points.

A mold for producing a porous material with a high melting point can be made by compacting an inorganic powder material, which is soluble in at least one solvent, to form a porous solid having interconnected powder particles. The molten material is then introduced into the pores of the mold where it solidifies. After cooling, the inorganic material is removed by the solvent.

Another technique involves a mold filled with granules. When the molten material is poured in the mold, the material penetrates into the voids between the granules and an interconnected cellular structure will be produced once the granules have been removed. The technique required for removing the granules will depend upon the specific granules utilized.

A mechanical method which produces a controlled pore structure involves a mold having opposing plates with pins protruding into the mold cavity. After a molten metal has been injected and solidified, the plates are moved apart and the pins removed providing the casting with its pore structure.

Foaming techniques have also been seen. According to these methods, a foaming agent is added to a molten metal and the resulting foam is cooled to form a solid of foamed metal. Typical foaming agents include hydrides, silicon, aluminum, sulphur, selenium and tellurium among others.

A limitation of the foaming process is that the size and distribution of the pores can only be controlled to a very limited extent. Another limitation of the foaming techniques which makes casting very difficult is the short time interval involved between adding the foaming agent and foam formation. Additional difficulties are caused by the premature decomposition of the foaming agent. If nonporous sections are desired within the casting, barrier layers must be provided producing additional difficulties. Thickening agents have been used in an attempt to control pore formation. However, these agents often produce negative effects with regard to the mechanical properties of the foamed metal.

Solutions to overcome the foregoing problems have been proposed which involve blowing bubbles of an inert gas into the molten material while the material concurrently solidifies. As such, the gas being blown into the melt causes the formation of hollow, semi-molten metal granules which become bound together to form a cellular type structure.

Review of the above methods for manufacturing porous materials shows that their common disadvantage lies primarily in their complexity. This complexity arises due to the necessity of involving a considerable number of operations and/or using a considerable number of preparatory stages. As a direct result, the cost of the produced product is high and the production rate is low. Both of which make the resulting material commercially impractical.

With the above limitations in mind, it is accordingly the primary object of the present invention to provide a simplified process for manufacturing porous articles, including pure metals, alloys and ceramics.

Another object of the invention is to provide a process which allows for predetermined sizes, shapes and orientations of pores within the article, as well as allowing for the formation of adjacent porous and nonporous regions.

The above objects are achieved as a result of the discovery of the in situ formation of pores during the decomposition of a liquid which is accompanied by the simultaneous occurrence of a crystalline phase and a gaseous phase. According to the present invention, a base material (metal, alloy or ceramic) is melted within an autoclave in an atmosphere of a gas, containing hydrogen, under a specified pressure. The melt is exposed to the gas for a period of time such that the hydrogen is dissolved therein and its concentration within the melt has reached a prescribed saturation value. This operation is hereinafter referred to as saturating.

After saturating, the melt (now containing the dissolved hydrogen gas therein) fills a mold also positioned within the autoclave. Immediately after filling, the pressure within the autoclave is set to a prescribed level and the melt is cooled. The pressure at which the melt is cooled is hereinafter referred to as the solidification pressure.

As the saturated melt solidifies, the solubility of the dissolved gas displays a sharp decrease. The quantity of gas which represents the difference between the gas content dissolved in the melt and the amount which is soluble in the solidified material evolves in the form of gas bubbles immediately ahead of the solidification front. The gas bubbles grow concurrently with the solid and do not leave the solidification front thus, forming the cellular structure.

The solidification pressure will be controlled after pouring depending on the desired pore size, pore structure and void content. If a porous article exhibiting cylindrical pores is desired, the solidification pressure is held constant until solidification has been completed and the heat flow through the article is controlled. If a more intricate pore structure is desired (e.g. tapered, ellipsoidal or spherical pores) the solidification pressure is accordingly increased or decreased during solidification. If a nonporous region is desired in the resulting product, the solidification pressure is significantly increased above an upper pressure limit after which pore formation will not occur.

Additional benefits and advantages of the present invention will become apparent to those skilled in the art to which this invention relates from the subsequent description of the preferred embodiments and the appended claims taken in conjunction with the accompanying drawings.

DETAILED DESCRIPTION OF THE DRAWINGS

DETAILED DESCRIPTION OF THE PREFERRED EMBODIMENTS

The method for manufacturing a porous material having predetermined pore shape and orientation according to the present invention, generally includes the steps of:

(a) providing a base material within an autoclave;
(b) providing the autoclave with an atmosphere of hydrogen-bearing gas having known composition;
(c) heating the base material to produce a molten material;
(d) providing the hydrogen gas at a predetermined partial pressure;
(e) dissolving hydrogen gas into the molten material;
(f) filling a mold located within the autoclave with the molten material;
(g) setting the system pressure at a predetermined solidification pressure; and
(h) solidifying the molten material at the solidification pressure to produce a simultaneous occurrence of a crystalline phase and an evolving gas along the solidification front.

Figure 1:
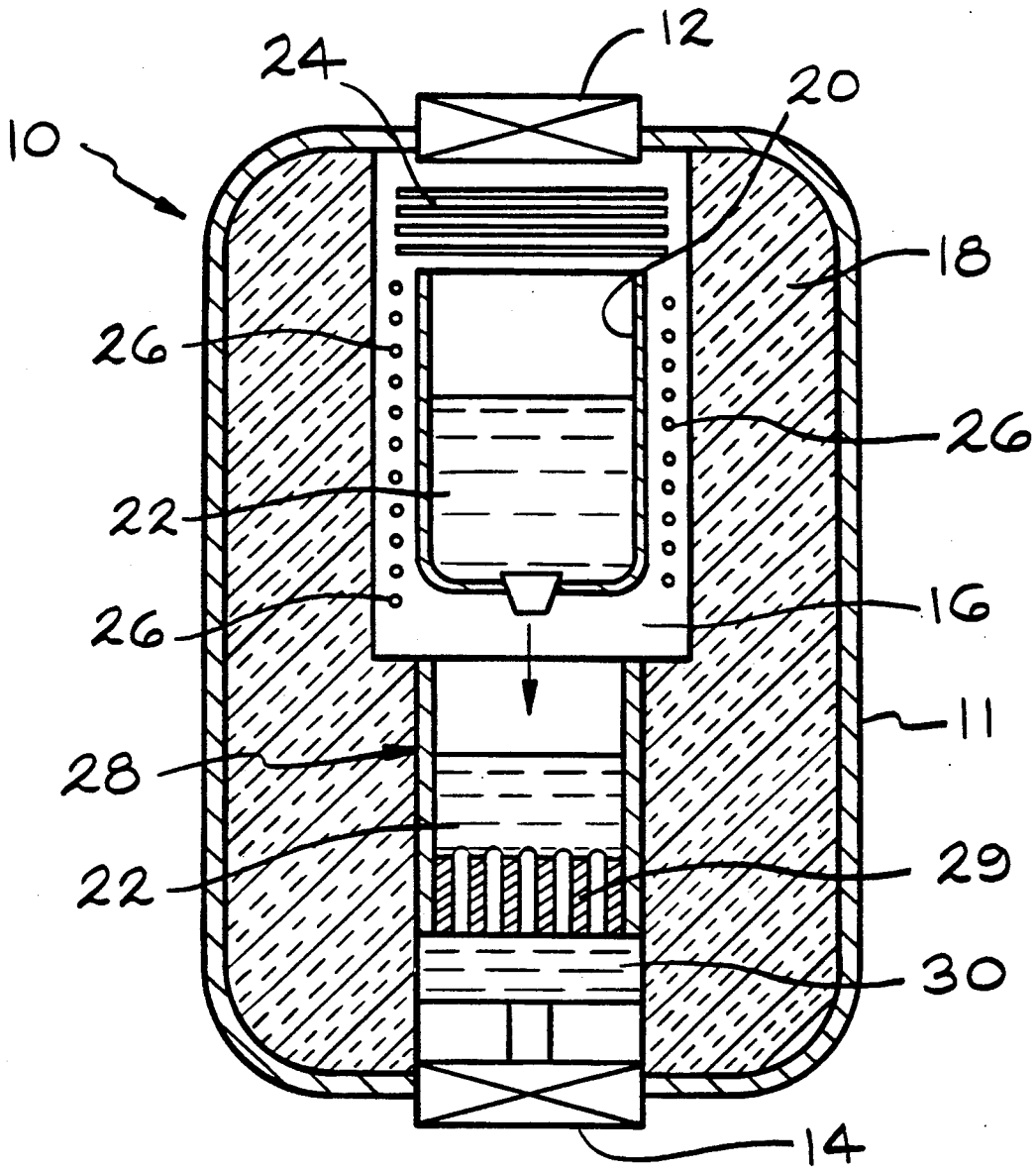
FIG. 1 is a diagrammatic view of an autoclave for developing axially oriented pores according to the principles of the present invention.

Now with reference to the drawing, FIG. 1 generally illustrates an autoclave, generally designated by reference number 10, in which the process of the present invention may be performed. The autoclave 10 is of a type which is generally known within the industry and is provided with accurate temperature and pressure control systems, generally designated by black boxes 21 and 23. The autoclave 10 is sealed by a casing 11 which may generally include a top cover 12 and a bottom cover 14 which will provide access into an interior chamber 16. The interior of chamber 16 is defined by an insulating material 18 which forms the walls of the autoclave 10. A ladle 20 is provided within the interior chamber 16 of the autoclave 10 and receives a starting or base material 22 therein. As mentioned above, base material 22 may be a pure metal, an alloy, or a ceramic material.

The interior chamber 16 is filled with a gas 24 through the gas supply pressure control system 23 to provide the desired atmosphere within the autoclave 10. As briefly outlined above, the gas is pure hydrogen or a hydrogen-containing mixture. Hydrogen is desirable because of its high solubility in various molten materials. Other gases may also be used. A hydrogen-based mixture may be provided wherein another gas of the mixture reacts with the base material 22 to produce a desired quality in the resulting material or product.

The interior chamber 16 is provided with a known type of temperature control system 21 which includes heating elements 26, which also may be of a type generally known within the industry. The heating elements 26 raise the temperature of the interior chamber 16 to a predetermined temperature (hereinafter the saturating temperature) resulting in the starting material 22 being transformed into a liquid phase, and which will be referred to as melt 22.

The pressure of the atmosphere within the autoclave 10 is controlled by the pressure control system 23 allowing the gas 24 to dissolve into the molten state of the base material 22. In the preferred embodiment, hydrogen is the gas 24 known to be soluble within the melt 22. In conjunction with the saturating temperature, it is the pressure of the hydrogen, or the partial pressure of hydrogen in a hydrogen-containing mixture, which controls the amount of hydrogen which is soluble in the melt 22. Thus, increased pressure increases the solubility of the gas 24 in the base material 22. The pressure of hydrogen within the atmosphere of autoclave 10 is herein referred to as the saturating pressure.

After a period of time, the concentration of hydrogen in the melt 22 reaches a prescribed level of saturation for the given saturation pressure.

After saturating, the melt 22 is poured from the ladle 20 into a suitable mold 28 which is also positioned within the autoclave 10 and the system pressure of the atmosphere within the autoclave 10 is then set to a prescribed level which is referred to as the solidification pressure. Whether the solidification pressure is increased, decreased, or remains constant will depend on the desired pore structure, pore size and content. It is conceivable that the base material 22 may be melted directly within the mold 28 and not require transferring from the ladle 20. The melt 22 is then cooled and solidified, generally designated by number 29.

As a result of the cooling of the melt 22 and controlling of the solidification pressure during solidification, the solubility of hydrogen within the melt 22 sharply decreases. The quantity of hydrogen which equals the difference between the dissolved hydrogen content within the melt 22 and the solubility of hydrogen within the solid at the given system pressure evolves in the form of gas bubbles immediately ahead of the solidification front. The gas bubbles grow concurrently with the solid and do not leave the solidification front thus forming a cellular structure within the solidified material.

Figure 9:
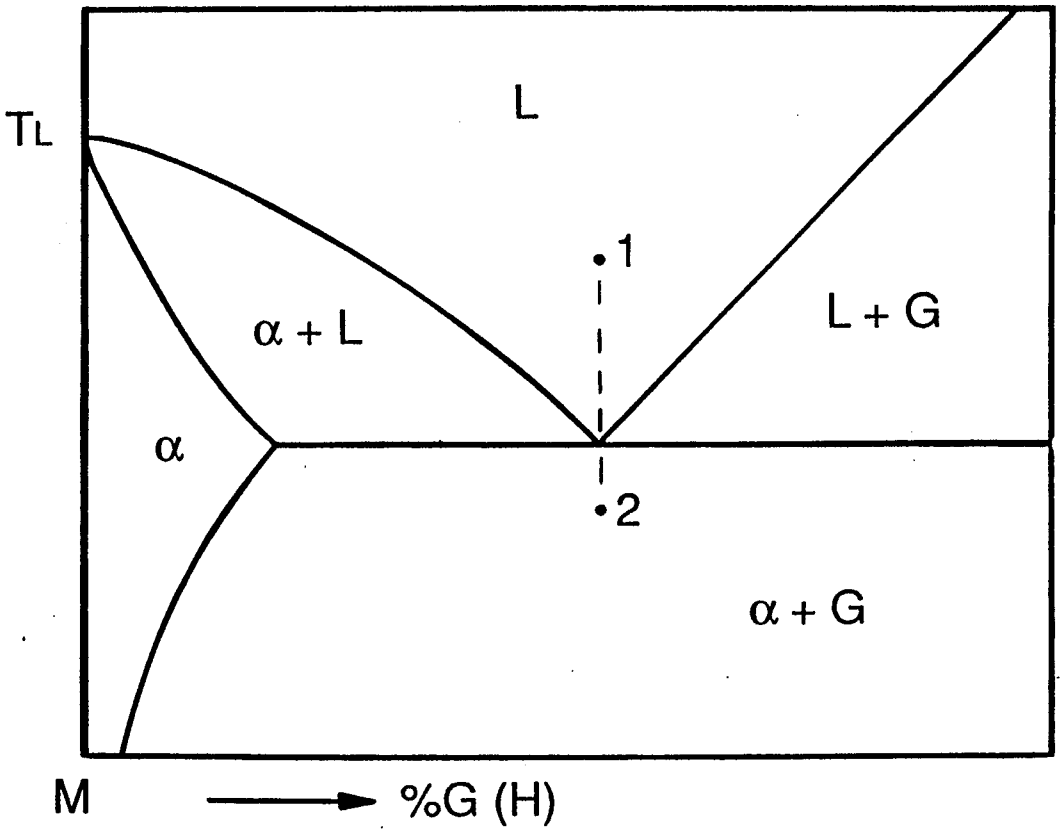
FIG. 9 is a phase diagram illustrating the phase changes involved in the present invention.

Thus, to ensure the proper development of the pore structure, it is preferred that the starting material 22 be provided in its eutectic composition. Referring now to FIG. 9, during solidification, the melt 22 will substantially proceed from a liquid phase having hydrogen gas dissolved therein directly into its crystalline phase while evolving the excess hydrogen. This is illustrated by the phase change which will occur as the melt 22 proceed from point 1, where it is a liquid (L) having hydrogen gas dissolved therein, to point 2 where the solidifying melt 29 is a solid ($\alpha$) having an amount of hydrogen gas dissolved therein but also evolving the excess hydrogen gas (G) to form the cellular structure.

Since the excess volume of hydrogen evolved during the solidification of the melt 29 will be determined by the saturation temperature and the saturation pressure, the void content of the material produced is a single valued function of the process parameters which include the saturating temperature, the solidification temperature, the saturating pressure and the solidification pressure. These parameters can be readily and precisely controlled within the autoclave 10 during all stages of the process. As a result, the quality of the porous material can be firmly controlled.

Figure 2:
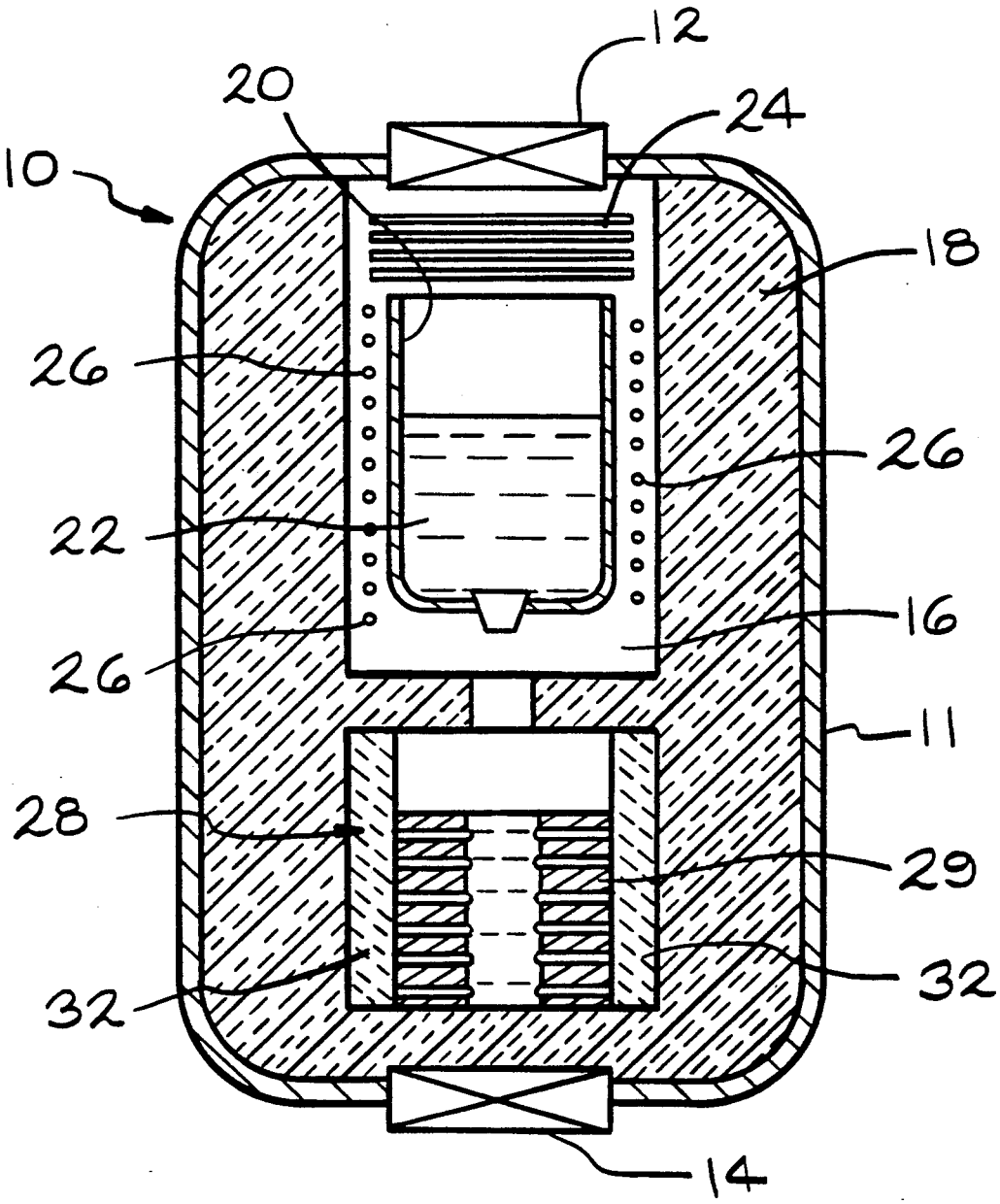
FIG. 2 is a diagrammatic view of an autoclave for developing radially oriented pores according to the principles of the present invention.
Figure 7:
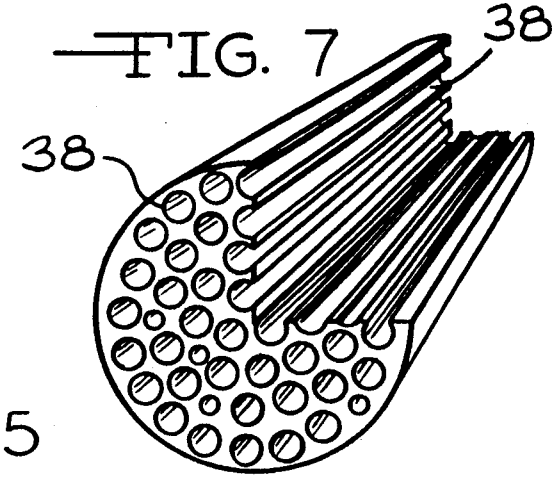
FIG. 7 is a diagrammatic perspective view of an article having a portion removed illustrating internal structure.
Figure 5:
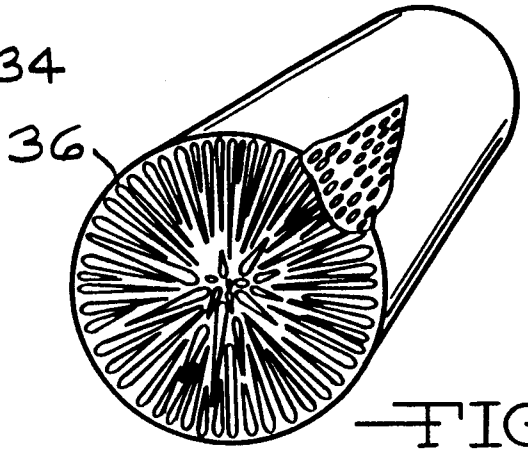
FIG. 5 is a diagrammatic perspective view of an article exhibiting radially oriented pores produced according to the principles of the present invention.

In addition to the above parameters, a major role in maintaining the desired pore structure is played by the direction of heat removal from the solidifying melt 29. In view of the fact that the pore structure will form and proceed similar to eutectic solidification, the pores will develop normally to the solidification front of the melt 22. Thus, to obtain pores which are directed axially in the final product, axial heat removal is needed and provided by an axially directed heat sink 30 is provided in the autoclave 10. As seen in FIG. 1 and 7, the melt 22 which has been poured into the mold 28 is solidifying in an axial or upward direction relative to the heat sink 30 and heat removal. Similarly, to obtain a radially directed pore structure, radial heat removal and a radially directed heat sink 32 are required. As seen in FIG. 2 and 5, the melt 22 which has been poured into the mold 28 is solidifying 29 in a radial or lateral direction relative to the heat sink 32 and heat removal.

Assuming that the void content E equals a ratio between the gas volume dissolved in the molten material ($V_g$) and the total volume of the material, which is a sum of the gas volume and the volume of the solid ($V_c$), the following relationships occur:

$$E = V_g / (V_g + V_c) \tag{1}$$

$$V_g = \Delta S \cdot m_c \cdot R \cdot T_c \cdot P_c \tag{2}$$

wherein $\Delta S$ is the difference between hydrogen content in the molten material and the amount of hydrogen which is dissolved in the solid, $m_c$ is the weight of the solid, R is the gas constant, $T_c$ is the absolute temperature of solidification, and $P_c$ is the solidification pressure. Substituting the gas Equation (2) into Equation (1), after simple rearrangements, a new definition of void content is obtained as follows:

$$E = (\Delta S \cdot R \cdot T_c)/(P_c \cdot \rho^{-1} + \Delta S \cdot R \cdot T_c) \tag{3}$$

wherein $\rho$ is the density of the solid.

The excess volume of hydrogen evolved during solidification is determined by the saturating temperature $T_s$ and the saturating pressure $P_s$.

$$\Delta S = K_L \cdot e^{\left(\frac{-\Delta H_L}{RTS}\right)} \cdot \sqrt{P_S} - K_c \cdot e^{\left(\frac{-\Delta H_c}{RT_c}\right)} \cdot \sqrt{P_c} \tag{4}$$

where $K_l$ is the solubility of hydrogen in the melt 22, $\Delta H_L$ is the heat of solution of hydrogen in the melt, K is the solubility of hydrogen in the solidified melt, and $\Delta H_c$ is the heat of solution of hydrogen in the solidified melt.

Thus, a final equation for the void content as a function of the saturating and the solidification parameters is:

$$E = \left[ \frac{P_c \cdot \rho^{-1}}{\left[ K_L \cdot \exp\left(\frac{-\Delta H_L}{RT_s}\right) \cdot \sqrt{P_s} - K_c \cdot \exp\left(\frac{-\Delta H_c}{RT_c}\right) \cdot \sqrt{P_c} \right] \cdot R \cdot T_c} + 1 \right]^{-1} \tag{5}$$

As is readily seen, Equation (5) shows that the void content of the produced article is a single value function of the process parameters $T_s$, $T_c$, $P_s$, and $P_c$. These parameters can be readily and precisely controlled during all stages of the process of the present invention to control the characteristics of the porous article produced. By way of illustration and not limitation, possible applications for materials produced according to the present invention include the following: self oiling bearings filters, heat exchangers, fuel nozzles, gas and liquid separators, heat pipes, pistons, lightweight structural members and catalyst carriers. Another example of an article which could be manufactured is an article having enclosed pores of hydrogen which provide efficient heat transfer through the combined effects of conductive heat transfer and convection within the pores. In all of the above applications, the advantages of the produced article include high strength and rigidity, the possibility of being produced in either permeable or impermeable form, the directional control of the pores in the resulting product, machinability, workability, weldability, and a wide range of pore diameters.

Figure 8:
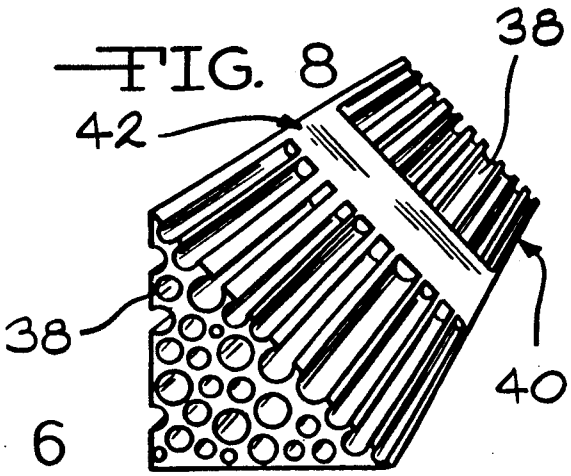
FIG. 8 is a diagrammatic perspective view illustrating an article formed by the principles of the present invention having cylindrical pore structures axially interrupted by a nonporous region.
Figure 6:
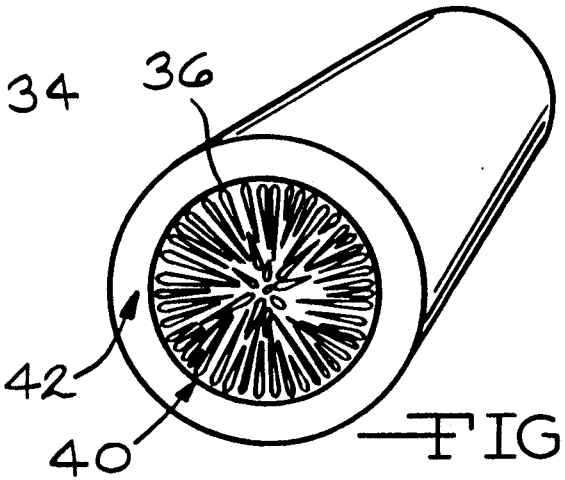
FIG. 6 is a diagrammatic perspective view substantially similar to that of FIG. 5 showing an article having a nonporous exterior region and a porous interior region formed according to the principles of the present invention.
Figure 3:
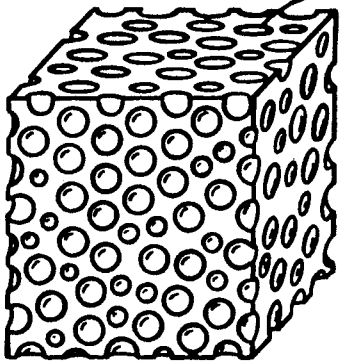
FIG. 3 is a diagrammatic perspective view of article exhibiting a generally spherical pore structure produced according to the principles of the present invention.
Figure 4:
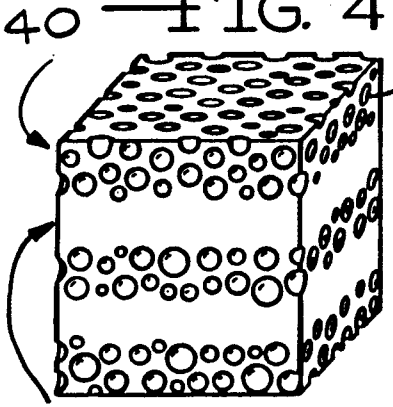
FIG. 4 is a diagrammatic perspective view similar to that shown in FIG. 3 and illustrating an article having adjacent porous and nonporous regions formed according to the principles of the present invention.

All basis shapes of primary production articles can be produced including rods, plates, pipes, and cones. While numerous base matrixes are contemplated by the present invention, specific examples include copper, iron, magnesium, nickel, alloys based upon these elements, and ceramics such as magnesium oxide and/or aluminum oxide. By controlling the pressure of the gas 24 as the gas 24 dissolves into the melt 22, only a preset amount of the gas 24 will be capable of dissolving into the melt 22. Using the above listed materials as at least one component of the base material 22, saturation pressures have been used in the range of 0.2–10 atmospheres (≈20 kPa–1 MPa) to produce porous articles. Through the controlled variation of the solidification pressure during solidification, various pore shapes can be formed. Again using the above listed materials as at least one component of the base material 22, solidification pressures int eh range of 0.05–30 atmospheres (≈5 kPa–3 MPa) have been used to produce porous articles according to the present invention. FIGS. 3 and 4 illustrate spherical pores 34. FIGS. 5 and 6 illustrate ellipsoidal pore structures 36 and FIGS. 7 and 8 illustrate cylindrical pore structures 38. Additional pore structures which are contemplated by the present invention include slot-like, conical, and necked. As seen in FIGS. 4, 6, and 8, by varying the solidification pressure for an elapsed period of time during solidification, it is possible to adjacently produce porous 40 and nonporous regions 42 within the same material.

In one example of the present invention aluminum (9%) bronze is melted in an autoclave 10 in a hydrogen atmosphere at a pressure of 0.6 MPa. The melt 22 is heated to 1,500 K, held for five minutes, and then poured into a mold 28 having a radial heat sink 32. Simultaneously, the pressure in the autoclave 10 is increased to 0.9 MPa. The increased pressure level is held constant until solidification is completed (about five minutes). The autoclave is then depressurized and the product removed. The final product consists of porous bronze having axially oriented pores with a total void content or porosity value of 35%.

According to Equation (5), increasing the pressure in the autoclave during solidification will produce lower porosities in the final product. From Equation (5), the upper pressure limit can be determined above which the porosity will be equal to zero, i.e. the material will be nonporous. When pressure is increased to the upper pressure limit during solidification, the formation of a nonporous layer will begin. Conversely, if the pressure is thereafter decreased below the upper pressure limit, a porous region in the material will again begin to form. In this way structures with alternating porous and nonporous regions can be obtained (see FIGS. 4 and 8) or an article having a nonporous "skin" can be produced (see FIG. 6).

Also according to Equation (5), it is possible to make converging pores by gradually increasing the pressure during directional solidification; diverging pores can be formed by decreasing the pressure during directional solidification.

The present invention is simple in operation and ensures high productivity while maintaining pore quality. The process of the present invention can be readily used on an industrial scale upon providing an autoclave having sufficient size, temperature control system, and an atmospheric system wherein the both composition and pressure of the atmosphere can be controlled.

It has been observed that porous structures made in accordance with this invention exhibit superior mechanical properties. In particular, porous articles having pores of equal to or less than 100 microns in size with a porosity of equal to or less than 35% have a specific strength that is greater than that of the bas material.

While the above description constitutes the preferred embodiments of the present invention, it will be appreciated that the invention is susceptible to modification, variation and change without departing from the proper scope and fair meaning of the accompanying claims.

I claim:

1. A process of forming a porous solid article comprising the steps of:

providing a base material;

heating said base material to cause said base material to melt to a liquid phase;

exposing said liquid phase of said base material to a gas which dissolves into said base material, said gas having a solubility in said base material which decreases with decreasing temperature of said base material and which increases with increasing pressure of said gas;

maintaining said gas at a predetermined pressure and allowing said gas to dissolve into said liquid phase of said base material;

cooling said base material causing said base material to solidify; and controlling the pressure of said gas during said cooling step to cause said gas to precipitate within said solidifying base material thereby forming pores in said base material and thereby forming said porous solid article.

2. The process of claim 1 wherein said base material is a metal.

3. The process of claim 1 wherein said gas is hydrogen.

4. The process of claim 1 wherein said controlling step comprises varying said predetermined pressure during said cooling step to provide variations int eh geometric characteristics of said pores.

5. The process of claim 1 wherein said controlling step comprises varying said predetermined pressure during said cooling step to provide solidified regions within said base material which are substantially free of said pores and other solidified regions within said base material in which said pores are formed.

6. The process of claim 1 wherein said step of cooling further comprises the step of controlling the direction of advancement of a solidifying front within said base material during said cooling step to thereby control the direction of longation of said pores.

7. The process of claim 6 wherein said step of controlling advancement comprises providing a heat sink radially surrounding a generally cylindrical mold within which said base material solidifies thereby generating pores which are elongated in a radial direction within said article.

8. The process of claim 6 wherein said step of controlling advancement comprises providing a heat sink adjacent at least one end of an elongated mold within which said base material solidifies thereby generating pores which are elongated axially within said article.

9. The process of claim 1 wherein said base material includes copper as a primary component and said base material is exposed to an atmosphere including hydrogen gas at a partial pressure of between 0.5 and 10.0 atmospheres during said exposing step, and during said cooling step is exposed to an atmosphere at a pressure of 1 to 25 atmospheres.

10. The process of claim 1 wherein said base material includes aluminum as a primary component, and said base material is exposed to an atmosphere including hydrogen gas at a partial pressure of between 1.5 and 10.0 atmospheres during said exposing step, and during said cooling step is exposed to an atmosphere at a pressure of 0.05 to 0.8 atmospheres.

11. The process of claim 1 wherein said base material includes nickel as a primary component, and said base material is exposed to an atmosphere including hydrogen gas at a partial pressure of between 3.0 and 8.0 atmospheres during said exposing step, and during said cooling step is exposed to an atmosphere at a pressure of 5.0 to 16.0 atmospheres.

12. The process of claim 1 wherein said base material includes magnesium as a primary component and said base material is exposed to an atmosphere including hydrogen gas at a partial pressure of between 0.2 and 5.0 atmospheres during said exposing step, and during said cooling step is exposed to an atmosphere at a pressure of 0.5 to 5.0 atmospheres.

13. The process of claim 1 wherein said base material includes iron as a primary component, and said base material is exposed to an atmosphere including hydrogen gas at a partial pressure of between 3.0 and 10.0 atmospheres during said exposing step, and during said cooling step is exposed to an atmosphere at a pressure of 6.0 to 30.0 atmospheres.

14. The process of claim 1 wherein said base material includes chromium as a primary component, and said base material is exposed to an atmosphere including hydrogen gas at a partial pressure of between 2.0 and 5.0 atmospheres during said exposing step, and during said cooling step is exposed to an atmosphere at a pressure of 4.0 to 25.0 atmospheres.

15. The method of claim 1 in which said base material is a ceramics based on the $AL_2O_3$–MgO system in the composition ratio 1:2 to 2:1, respectively, wherein said exposing step occurs in an atmosphere of hydrogen gas at a partial pressure of 0.8–1.7 atmospheres and said cooling step occurs in an atmosphere at a pressure of 0.9–2.5 atmospheres.

16. The process of claim 1 wherein said cooling step occurs along a process phase line which transitions directly from a phase of liquid having dissolved hydrogen to a phase of solid base material with hydrogen gas forming said pores.

17. The process of claim 16 wherein said cooling step occurs without the significant generation of either a combined liquid and gas phase or a combined solid and liquid phase.

18. The process of claim 1 wherein said controlling step comprises increasing the pressure of said gas to a pressure above said predetermined pressure during said cooling step.

19. The process of claim 1 wherein said controlling step comprises decreasing the pressure of said gas to a pressure above said predetermined pressure during said cooling step.

* * * * *